US010161219B2

(12) United States Patent
Richards

(10) Patent No.: US 10,161,219 B2
(45) Date of Patent: Dec. 25, 2018

(54) GRAVEL PACK-CIRCULATING SLEEVE WITH HYDRAULIC LOCK

(71) Applicant: HALLIBURTON ENERGY SERVICES, INC., Houston, TX (US)

(72) Inventor: William Mark Richards, Flower Mound, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 190 days.

(21) Appl. No.: 14/653,421

(22) PCT Filed: May 12, 2014

(86) PCT No.: PCT/US2014/037653

§ 371 (c)(1),
(2) Date: Jun. 18, 2015

(87) PCT Pub. No.: WO2015/174954

PCT Pub. Date: Nov. 19, 2015

(65) Prior Publication Data

US 2016/0281466 A1 Sep. 29, 2016

(51) Int. Cl.

| | |
|---|---|
| ***E21B 34/06*** | (2006.01) |
| ***E21B 34/14*** | (2006.01) |
| ***E21B 43/04*** | (2006.01) |
| *E21B 34/00* | (2006.01) |

(52) U.S. Cl.

CPC ..... *E21B 34/14* (2013.01); *E21B 34/063* (2013.01); *E21B 43/045* (2013.01); *E21B 2034/007* (2013.01)

(58) Field of Classification Search

CPC ..... E21B 34/14; E21B 34/065; E21B 34/063; E21B 43/045; E21B 2034/007

See application file for complete search history.

(56) References Cited

U.S. PATENT DOCUMENTS

| | | | | |
|---|---|---|---|---|
| 2,358,944 | A * | 9/1944 | Taylor, Jr. | E21B 34/14 417/146 |
| 4,512,188 | A * | 4/1985 | Erickson | F04B 9/115 166/90.1 |
| 6,367,552 | B1 | 4/2002 | Scott et al. | |
| 6,540,025 | B2 | 4/2003 | Scott et al. | |

(Continued)

OTHER PUBLICATIONS

Halliburton, Long Space-Out Travel Joint, at least as early as 2011, 2 pages.

(Continued)

*Primary Examiner* — Taras P Bemko
*Assistant Examiner* — Brandon M Duck
(74) *Attorney, Agent, or Firm* — Kilpatrick Townsend & Stockton LLP

(57) ABSTRACT

A system and method for selectively locking open or close a gravel pack-circulating sleeve is disclosed. The sleeve is movably coupled to a first chamber containing a fluid. The first chamber is fluidly connected to a second chamber through a fluid flow controller. Shifting of the sleeve between open and closed positions is resisted by a the fluid flow controller. The resistance to fluid flow can reduce or eliminate inadvertent shifting of the sleeve due to short bumps and small loads upon the sleeve. To overcome the resistance to fluid flow and to shift the sleeve, a continuous load can be applied to the sleeve.

21 Claims, 9 Drawing Sheets

(56) References Cited

U.S. PATENT DOCUMENTS

| | | | | |
|---|---|---|---|---|
| 2005/0000693 | A1* | 1/2005 | Ravensbergen | E21B 17/06 166/301 |
| 2009/0056934 | A1 | 3/2009 | Xu et al. | |
| 2011/0186300 | A1* | 8/2011 | Dykstra | E21B 34/08 166/316 |
| 2011/0315390 | A1 | 12/2011 | Guillory et al. | |
| 2012/0012322 | A1 | 1/2012 | Korkmaz et al. | |
| 2013/0025872 | A1 | 1/2013 | Mailand et al. | |
| 2013/0186635 | A1 | 7/2013 | King et al. | |
| 2013/0277059 | A1* | 10/2013 | Holderman | E21B 34/08 166/319 |
| 2016/0376871 | A1* | 12/2016 | Voon | E21B 21/106 166/319 |

OTHER PUBLICATIONS

Halliburton, RapidStart Initiator CT Sleeve, at least as early as May 12, 2014, 2 pages.

Louie, Crafting a Better Frac, Nov. 2014, 3 pages.

International Patent Application No. PCT/US2014/037653 , International Search Report and Written Opinion, dated Feb. 6, 2015, 14 pages.

* cited by examiner

GRAVEL PACK-CIRCULATING SLEEVE WITH HYDRAULIC LOCK

CROSS-REFERENCE TO RELATED APPLICATIONS

This is a U.S. national phase under 35 U.S.C. § 371 of International Patent Application No. PCT/US2014/037653, titled "Gravel Pack-Circulating Sleeve with Hydraulic Lock" and filed May 12, 2014, the entirety of which is hereby incorporated by reference herein.

TECHNICAL FIELD

The present disclosure relates to downwell oilfield operations generally and more specifically to gravel packing equipment.

BACKGROUND

In downwell oilfield operations, ports on a tool can be shifted when the tool is downwell. In one example, a gravel pack-circulating sleeve can be used downwell during gravel packing procedures. The sleeve can be shifted between open and closed positions. To shift the sleeve between open and closed positions, a shifting tool can be used to transfer force to the sleeve to shift the sleeve. A sleeve can be fully or partially shifted inadvertently, however, due to accidental bumping or jarring from a shifting tool or another tool downwell, or from movement of the sleeve itself. Full or partial shifting can result in leaks or other costly problems. Partial shifting can cause leaks that damage the sealing elements of the tool over time. In some situations, a fluid leak can increase the difficulty in closing the sleeve after it has been inadvertently opened. Because of the possibility of a sleeve being "bumped" open or closed, it can become difficult to know or assume the correct status of the sleeve downwell. Some sleeves can include a mechanical device that increases the force required to begin shifting the sleeve, but once that force is achieved, the sleeve shifts quickly and easily. Therefore, if the sleeve is quickly bumped enough to overcome the force required to begin shifting the sleeve, the sleeve can remain in a partially shifted state or can shift completely.

BRIEF DESCRIPTION OF THE DRAWINGS

The specification makes reference to the following appended figures, in which use of like reference numerals in different figures is intended to illustrate like or analogous components

DETAILED DESCRIPTION

Figure 1:
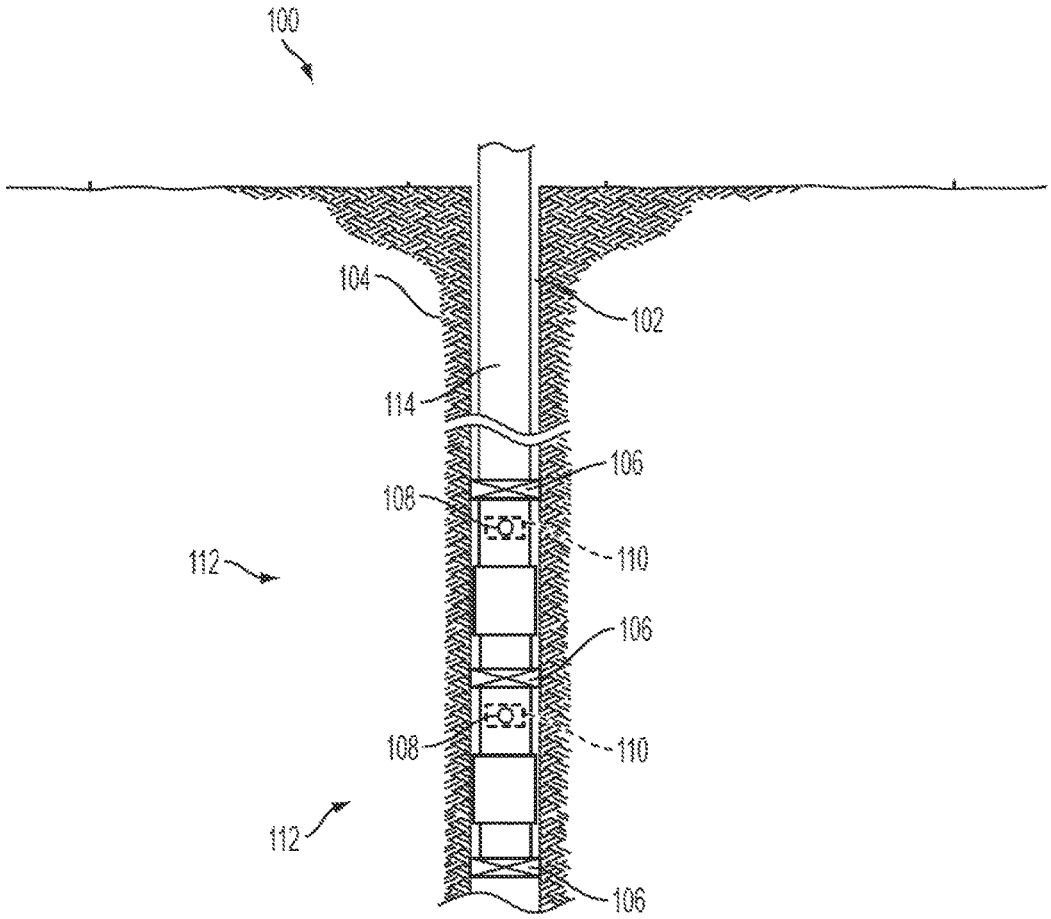
FIG. 1 is a schematic diagram of a wellbore servicing system including a gravel packing assembly according to one embodiment.

Certain aspects and features of the present disclosure relate to selectively locking a gravel pack-circulating sleeve open or closed. The sleeve can be shifted between open and closed positions (e.g., from open to closed and from closed to open). Movement of the sleeve can change the volume of a chamber containing a fluid. The chamber can be fluidly connected to a second chamber through a fluid flow controller that provides resistance to fluid flow. The resistance to fluid flow can reduce or eliminate inadvertent shifting of the sleeve due to short bumps and small loads upon the sleeve. In order to overcome the resistance to fluid flow and to shift the sleeve, a continuous load can be applied to the sleeve.

A shifting tool can locate a shifting profile in the sleeve. The shifting tool can compress fluid in one chamber to cause fluid to transfer through a sized orifice into a second chamber. The force and time involved to shift the sleeve can be determined by the sized orifice in the hydraulics. The force used to close the gravel pack-circulating sleeve can be very low (e.g., around 1,000 lbs) and the force used to open the gravel pack-circulating sleeve can be high (e.g., around 25,000 lbs). In alternate embodiments, the force to both open and close the sleeve can be high.

Because of the delay implemented by the fluid flowing through the sized orifice, a steady force may be needed for a short time period measured in minutes to open or close the sleeve. The delay can prevent accidental "bumping" of the sleeve that results in opening or closing the sleeve. The hydraulics can avoid the decrease in shifting forces that can occur with collet designs and other similar mechanical designs that rely on deflection or strain placed on one or more parts.

In an alternate embodiment, one or more pistons can be coupled to an inset. The use of the pistons can be preferred in some cases. Each piston can have a metered valve to limit the flow rate through the piston. A metered check valve can have a minimum pressure to open and allow fluid to flow through the check valve. The force used to shift the insert can be set by the micro-hydraulics of the metered valve.

In some embodiments, a steady force may be needed to shift the sleeve, thereby preventing the sleeve from accidentally shifting, such as from a bump. The hydraulics used can be pre-configured to allow for low- or high-shifting forces over a short amount of time. The time required to for low shifting force may be short relative to the amount of time needed to shift the opposite direction with a high shifting force. The shifting forces can be selected for opening and closing individually, or can be the same for both opening and closing. The hydraulics can be balanced to the tubing pressure. The use of existing shifting tools can be used. A selective profile can be used.

In some embodiments, a rupture disc can be placed into the system in case a failure in the fluid flow controller causes the sleeve to lock in place. If a sufficiently large amount of pressure is applied from a shifting tool, the rupture disc can break and allow fluid flow into one of the sealed chambers of the hydraulic system, bypassing the hydraulic system's effect on the shifting of the sleeve.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative embodiments but, like the illustrative embodiments, should not be used to limit the present disclosure. The elements included in the illustrations herein may be drawn not to scale.

FIG. 1 is a schematic diagram of a wellbore servicing system 100 that includes a gravel packing assembly 112 according to one embodiment. The wellbore servicing system 100 also includes a wellbore 102 penetrating a subterranean formation 104 for the purpose of recovering hydrocarbons, storing hydrocarbons, disposing of carbon dioxide, or the like. The wellbore 102 can be drilled into the subterranean formation 104 using any suitable drilling technique. While shown as extending vertically from the surface in FIG. 1, in other examples the wellbore 102 can be deviated, horizontal, or curved over at least some portions of the wellbore 102. The wellbore 102 can be cased, open hole, contain tubing, and can include a hole in the ground having a variety of shapes or geometries.

A service rig, such as a drilling rig, a completion rig, a workover rig, or other mast structure or combination thereof can support a workstring 114 in the wellbore 102, but in other examples a different structure can support the workstring 114. For example, an injector head of a coiled tubing rigup can support the workstring 114. In some aspects, a service rig can include a derrick with a rig floor through which the workstring 114 extends downward from the service rig into the wellbore 102. The servicing rig can be supported by piers extending downwards to a seabed in some implementations. Alternatively, the service rig can be supported by columns sitting on hulls or pontoons (or both) that are ballasted below the water surface, which may be referred to as a semi-submersible platform or rig. In an off-shore location, a casing may extend from the service rig to exclude sea water and contain drilling fluid returns. Other mechanical mechanisms that are not shown may control the run-in and withdrawal of the workstring 114 in the wellbore 102. Examples of these other mechanical mechanisms include a draw works coupled to a hoisting apparatus, a slickline unit or a wireline unit including a winching apparatus, another servicing vehicle, and a coiled tubing unit.

The workstring 114 can include one or more gravel packing assemblies 112 positioned between packers 106. A gravel packing assembly 112 can include a port 108 and a port sleeve 110. The port sleeve 110 can move between a closed position at which the port sleeve 110 substantially prevents fluid flow through the port 108 and an open position at which the port sleeve 110 substantially allows fluid flow through the port. When the port sleeve 110 is in an open position, gravel or other materials can pass through the port 108.

Figure 2A:
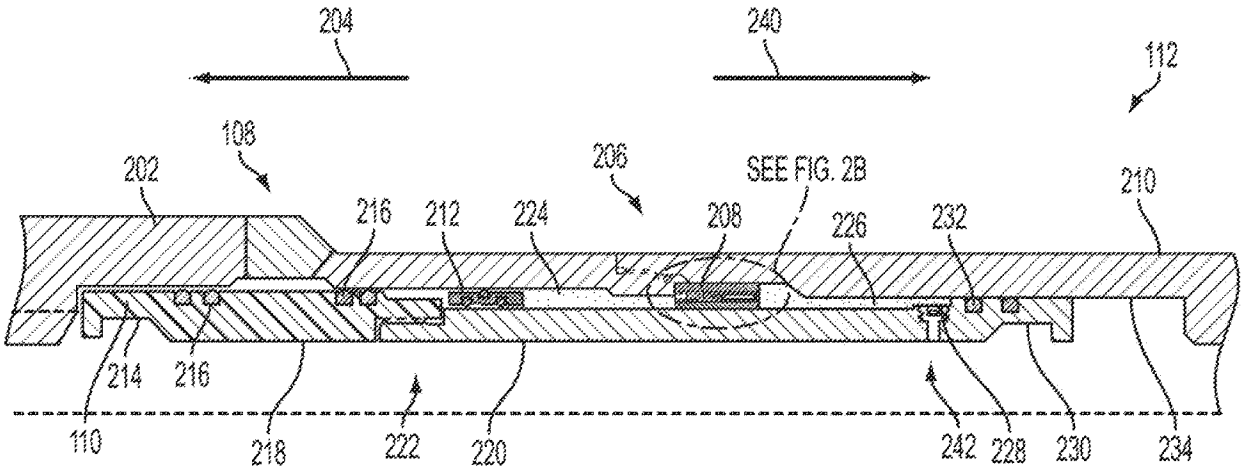
FIG. 2A is a cross-sectional view of a gravel packing assembly with a port sleeve in a closed position according to one embodiment.

FIG. 2A is a cross-sectional view of a gravel packing assembly 112 with a port sleeve 110 in a closed position according to one embodiment. The gravel packing assembly 112 includes a first tubular 202 coupled to a second tubular 210 by a sealed joint 206. The sealed joint 206 can be a threaded joint or other suitable joint. The sealed joint 206 can include one or more individual seals. In some alternate embodiments, a single tubular is used without any sealed joint 206. The first tubular 202 can include a port 108 and a sleeve recess 234.

As seen in FIG. 2A, the gravel packing assembly 112 can be positioned such that the surface is towards the left side of the image and the toe of the wellbore is towards the right side of the image. As used herein, the term "upwell" means towards the surface and "downwell" means away from the surface (e.g., towards the toe of the wellbore). The first tubular 202 can have a first diameter upwell of the port 108 and a second diameter downwell of the port 108. The first diameter can be larger than the second diameter, so any fluids exiting through the port 108 will generally flow downwell. In alternate embodiments, the first diameter can be smaller than the second diameter to allow fluids exiting through the port 108 to more easily flow upwell.

In further alternate embodiments, the gravel packing assembly 112 can be positioned such that the surface is towards the right side of the image and the toe of the wellbore is towards the left side of the image. In such embodiments, it may be desirable for the diameter of the first tubular 202 to be larger between the port 108 and the surface than the diameter of the first tubular 202 between the port 108 and the toe of the wellbore, as discussed in further detail below.

A port sleeve 110 can be positioned within the sleeve recess 234 and can slide between an open position at which the port sleeve 110 substantially allows fluid flow through the port 108 and a closed position at which the port sleeve 110 substantially prevents fluid flow through the port 108. When the port sleeve 110 is in a closed position, seals 216 positioned between the first tubular 202 and the port sleeve 110 seal the port 108.

In some embodiments, the port sleeve 110 can include a first portion 218 and a second portion 220 joined at a joint 222. The joint 222 can be a threaded joint or other suitable joint. The joint 222 can be non-sealed to allow pressure to equalize across both sides of the joint 222. In alternate embodiments, the port sleeve 110 can include a single portion with no joint 222. When the port sleeve 110 is a single portion with no joint 222, a port can be positioned in the port sleeve 110 to allow the balance piston 212 to equalize.

The port sleeve 110 can include a first shifting profile 214 and a second shifting profile 230. The first shifting profile 214 can be shaped to allow a shifting tool to engage the first shifting profile 214 to apply force in a first direction 204. Application of force to the port sleeve 110 in the first direction 204 can shift the port sleeve 110 into a closed position. The second shifting profile 230 can be shaped to allow the shifting tool to engage the second shifting profile 230 to apply force in a second direction 240. Applying force to the port sleeve 110 in the second direction 240 can shift the port sleeve 110 into an open position.

A first chamber 224 can be located between the port sleeve 110 and one or more of the first tubular 202 and the second tubular 210. The first chamber 224 can be closed at one end by a balance piston 212. The balance piston 212 can be operable to move and compress the first chamber 224 to reduce pressure differentials between the first chamber 224 and an external environment. The external environment can be any environment outside of the first chamber 224 and the second chamber 226. In one embodiment, the balance piston 212 can be operable to reduce pressure differentials between the first chamber 224 and the downwell environment during run-in and during changes in the downwell environment. A fluid flow controller 208 can define the end of the first chamber 224 opposite the balance piston 212. The fluid flow controller 208 can control fluid flow between the first chamber 224 and a second chamber 226.

The second chamber 226 can be located between the port sleeve 110 and one or more of the first tubular 202 and the second tubular 210. The second chamber 226 can be sealed at one end by seals 232 positioned between the port sleeve 110 and one of the first tubular 202 and the second tubular 210. The fluid flow controller 208 can define the end of the second chamber 226 opposite the seals 232.

The first chamber 224 and the second chamber 226 can contain an incompressible fluid. Force applied to the port sleeve 110 can cause pressure changes within the first chamber 224 and second chamber 226. Force applied to shift the port sleeve 110 in the second direction 240 can cause the pressure in the first chamber 224 to increase while causing the pressure in the second chamber 226 to decrease. The first chamber 224 can be driven to compress because force applied to shift the port sleeve 110 in the second direction 240 forces the balance piston 212 in the second direction 240 due to the balance piston 212 engaging a feature of the port sleeve 110, such as an edge of the joint 222. The second chamber 226 can be driven to expand because force applied to shift the port sleeve in the second direction 240 forces the seals 232 of the port sleeve 110 to move in the second direction 240. Force applied to shift the port sleeve 110 in the first direction 240 can cause the pressure in the first chamber 224 to increase while causing the pressure in the second chamber 226 to decrease. The fluid flow controller 208 can control the flow of fluid between the first chamber 224 and the second chamber 226 to equalize the pressures in the first chamber 224 and the second chamber 226. The flow of fluid between the first chamber 224 and the second chamber 226 can enable one of the first chamber 224 or the second chamber 226 to expand while the other chamber contracts to shift the port sleeve 110 between open and closed positions.

The fluid flow controller 208 can include one or more hydraulic elements that control how fluid flows within the fluid flow controller 208.

For example, the fluid flow controller 208 can include a hydraulic element that is a pressure-sensitive valve, such as a cracking valve (e.g., a cracking valve sold by Lee Hydraulics), that does not allow fluid flow until a certain pressure (e.g., 1000 psi) is reached. A fluid flow controller 208 with a cracking valve can prevent a port sleeve 110 from shifting when the force applied does not reach a minimum amount of force necessary to build sufficient pressure across the fluid flow controller 208 to open the cracking valve. The use of a cracking valve can protect against accidental shifting of the port sleeve 110 due to inadvertent and small force "bumps."

The fluid flow controller 208 can include a hydraulic element that is a flow metering device, such as a sized orifice, to limit the rate of fluid flow between the first chamber 224 and the second chamber 226. The use of a flow metering device can reduce the speed of fluid flow through the fluid flow controller 208, thus reducing the speed with which the pressure differential across the fluid flow controller 208 can be equalized. To shift the port sleeve 110 when the fluid flow controller 208 includes a flow metering device, a constant application of force may be needed that is for a sufficient length of time to equalize the pressure differential across the fluid flow controller 208. The use of a flow metering device can protect against accidental shifting of the port sleeve 110 due to inadvertent and quick "bumps."

In some embodiments, the fluid flow controller 208 can include one or more hydraulic elements in serial or parallel fluid communication. In an embodiment, a fluid flow controller 208 can include multiple, parallel fluid paths between the first chamber 224 and the second chamber 226. One or more of the fluid paths can include a hydraulic element that is a check valve that allows fluid flow in one direction and substantially prevents fluid flow in an opposite direction. The use of check valves, with or without other hydraulic elements, can allow the shifting properties (e.g., necessary force and speed) of shifting the port sleeve 110 from an open to a closed position to differ from the shifting properties of shifting the port sleeve 110 from a closed to an open position.

In some embodiments, the fluid flow controller 208 can include hydraulic elements that can enable the port sleeve 110 to be shifted from an open position to a closed position faster and easier (i.e., with less force applied to the port sleeve 110) than from a closed position to an open position. A port sleeve 110 that involves significantly more time and force to shift to an open position than to a closed position can be useful in a gravel packing assembly 112 because closing a port quickly can ensure treatment that is pumped out of the port does not leak back into the port. In alternate embodiments, a port sleeve 110 that involves significantly more time and force to shift to a closed position than to an open position can be useful in an assembly other than a gravel packing assembly 112, such as a production assembly, because opening a port quickly can allow fluids, such as production fluids, to pass through the port.

In some embodiments, an rupture element 228, such as a rupture disk, can be positioned between the second chamber 226 and an external environment. The external environment can be any environment located outside of the first chamber 224 and the second chamber 226. In one embodiment, the rupture element 228 can be positioned between the second chamber 226 and the downwell environment. The rupture element 228 can be positioned to occlude an escape port 242 in the port sleeve 110. In an emergency, such as if the port sleeve 110 becomes stuck, a shifting tool can apply a large amount of force to the port sleeve 110 to cause a significant pressure differential between the second chamber 226 and the downwell environment. If the pressure differential is greater than the limits of the rupture element 228, the rupture element 228 can rupture to open the escape port 242 and allow the pressure within the second chamber 226 to equalize to that of the external environment, such as the downwell environment. Because both the first chamber 224 and the second chamber 226 can be equalized to the external environment when the escape port 242 is open, no pressure differential may be present across the fluid flow controller 208, and the port sleeve 110 can shift with ease.

Figure 2B:
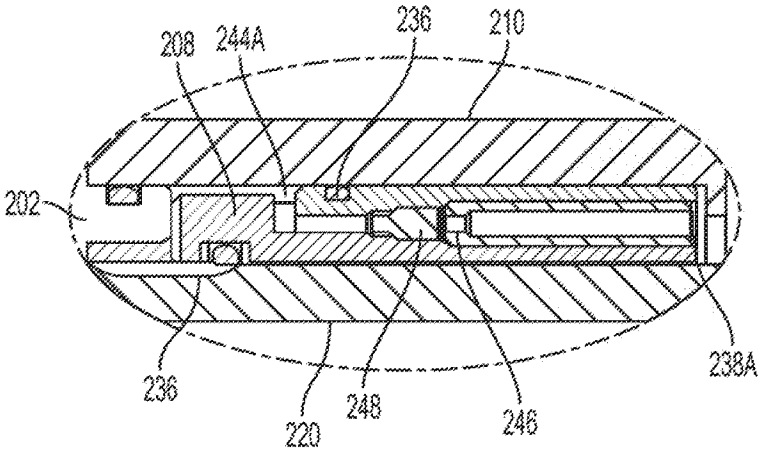
FIG. 2B is a close-up cross-sectional view of the fluid flow controller of FIG. 2A according to one embodiment.

FIG. 2B is a close-up cross-sectional view of the fluid flow controller 208 of FIG. 2A according to one embodiment. The fluid flow controller 208 can include a first fluid pathway between a first primary opening 244A on the side of the first chamber 224 and a first secondary opening 238A on the side of the second chamber 226. The fluid flow controller 208 can include seals 236 that can ensure that fluid is prevented from flowing around the fluid flow controller 208. The first pathway can include a sized orifice 246 and a cracking valve 248.

Figure 2C:
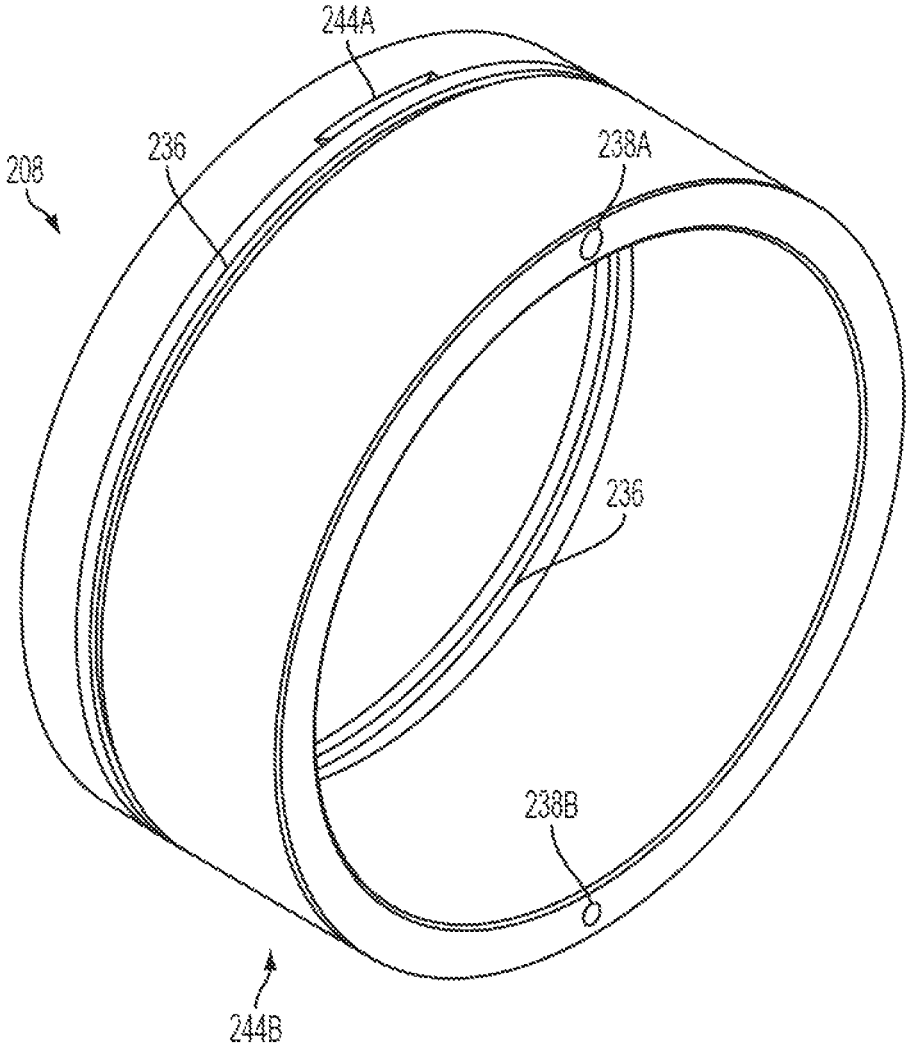
FIG. 2C is an axonometric projection of the fluid flow controller of FIG. 2B according to one embodiment.

FIG. 2C is an axonometric projection of the fluid flow controller 208 of FIG. 2B according to one embodiment. The fluid flow controller 208 can be circular in shape and can include seals 236 that are circular. The fluid flow controller 208 can have a first pathway between a first primary opening 244A and a first secondary opening 238A. The fluid flow controller can have a second pathway between a second primary opening 244B and a second secondary opening 238B. Each pathway can include hydraulic elements and opposite check valves, such that the first pathway can allow pressure equalization by enabling fluid flow from the first chamber 224 to the second chamber 226, and the second pathway can allow pressure equalization by enabling fluid flow from the second chamber 226 to the first chamber 224. Both chambers can include a sized orifice 246 and a cracking valve 248 to control fluid flow. The first pathway can include a cracking valve 248 that involves a larger pressure differential to open than a cracking valve of the second pathway. The first pathway can also include a sized orifice 246 having greater resistance to fluid flow than a sized orifice of the second pathway.

Figure 3:
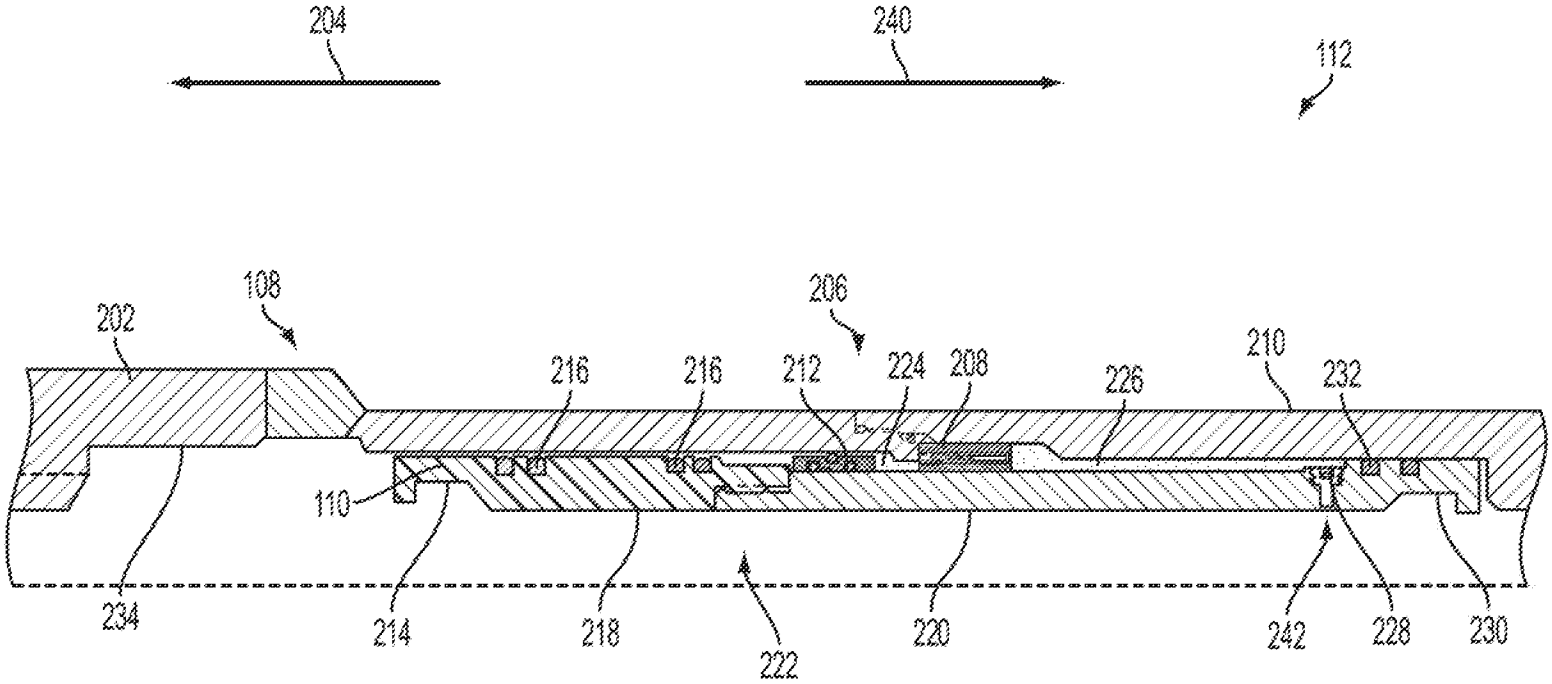
FIG. 3 is a cross-sectional view of the gravel packing assembly of FIG. 2A with the port sleeve in an open position according to one embodiment.

FIG. 3 is a cross-sectional view of the gravel packing assembly 112 of FIG. 2A with the port sleeve 110 in an open position according to one embodiment. In an open position, the port sleeve 110 substantially allows fluid flow through the port 108. The volume of the first chamber 224 can be smaller in the open position than the volume of the first chamber 224 in the closed position. The volume of the second chamber 226 can be larger in the open position than the volume of the second chamber 226 in the closed position.

Figure 4:
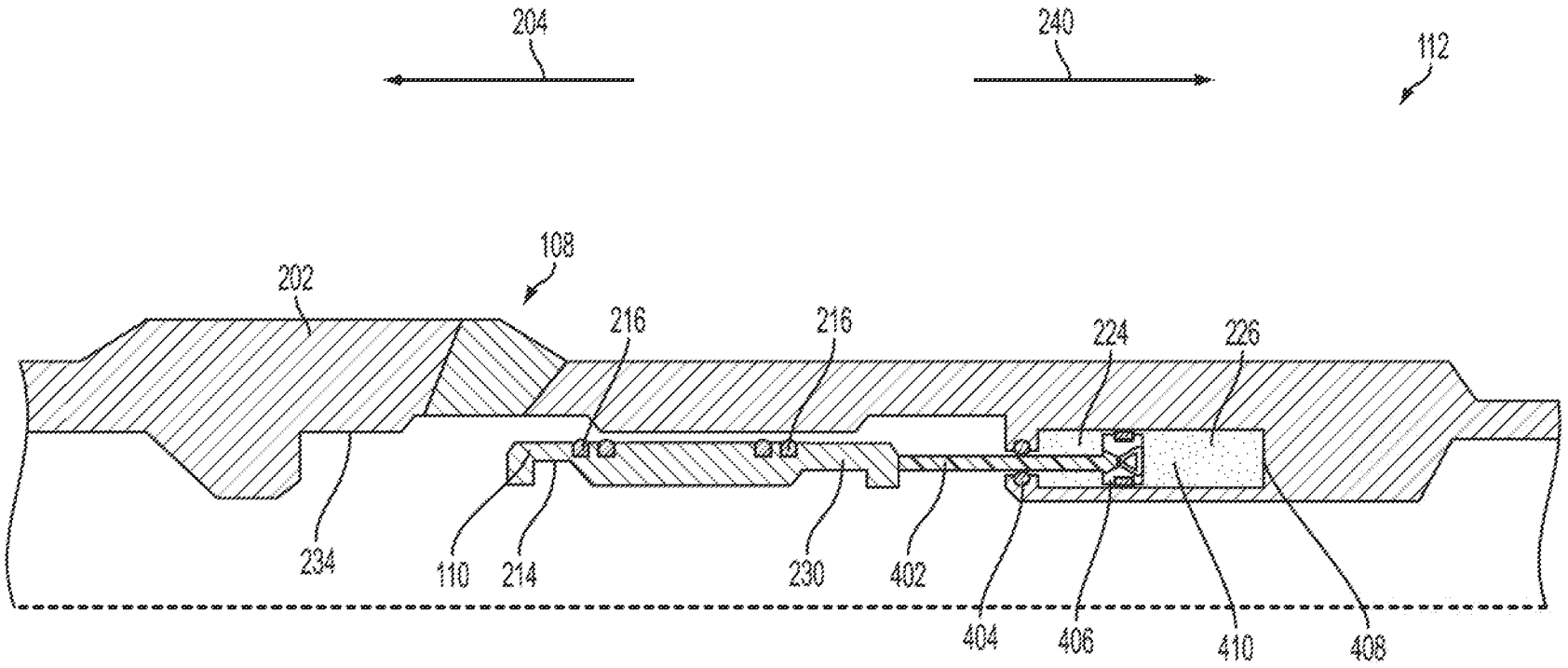
FIG. 4 is a cross-sectional view of a gravel packing assembly with a port sleeve in an open position and coupled to a piston head according to one embodiment.

FIG. 4 is a cross-sectional view of a gravel packing assembly 112 with a port sleeve 110 in an open position and coupled to a piston head 406 according to one embodiment. The gravel packing assembly 112 includes a first tubular 202 having a port 108 and a sleeve recess 234. A port sleeve 110 can be positioned within the sleeve recess 234 and can slide between an open position at which the port sleeve 110 substantially allows fluid flow through the port 108 and a closed position at which the port sleeve 110 substantially prevents fluid flow through the port 108. When the port sleeve 110 is in a closed position, seals 216 positioned between the first tubular 202 and the port sleeve 110 can seal the port 108.

The port sleeve 110 can include a first shifting profile 214 and a second shifting profile 230. The first shifting profile 214 can be shaped to allow a shifting tool to engage the first shifting profile 214 to apply force in a first direction 204. Applying force to the port sleeve 110 in the first direction 204 can shift the port sleeve 110 into a closed position. The second shifting profile 230 can be shaped to allow the shifting tool to engage the second shifting profile 230 to apply force in a second direction 240. Applying force to the port sleeve 110 in the second direction 240 can shift the port sleeve 110 into an open position.

A piston chamber 408 can be separated into a first chamber 224 and a second chamber 226 by a piston head 406. The first chamber 224 can be sealed from the downwell environment by a seal 404. The piston head 406 can be mechanically coupled to the port sleeve 110 by a piston arm 402. The piston head 406 can include a fluid flow controller 410 to control fluid flow between the first chamber 224 and the second chamber 226. The fluid flow controller 410 can include hydraulic elements as described above with reference to fluid flow controller 208.

The first chamber 224 and the second chamber 226 can include an incompressible fluid. Force applied to the port sleeve 110 can be converted into pressure changes within the first chamber 224 and second chamber 226. Force applied to shift the port sleeve 110 in the second direction 240 can cause the pressure in the first chamber 224 to decrease, while causing the pressure in the second chamber 226 to increase, due to movement of the piston head 406. Likewise, force applied to shift the port sleeve 110 in the first direction 204 can cause the pressure in the first chamber 224 to increase while causing the pressure in the second chamber 226 to decrease. The fluid flow controller 410 in the piston head 406 can control the flow of fluid between the first chamber 224 and the second chamber 226 to equalize the pressures in the first chamber 224 and the second chamber 226. The flow of fluid between the first chamber 224 and the second chamber 226 can enable one of the first chamber 224 or the second chamber 226 to expand while the other chamber contracts, thus shifting the port sleeve 110 between open and closed positions.

The fluid flow controller 410 can include hydraulic elements similar to those described above with reference to the fluid flow controller 208 to enable the port sleeve 110 to open and close at different rates and with different degrees of shifting force.

Figure 5:
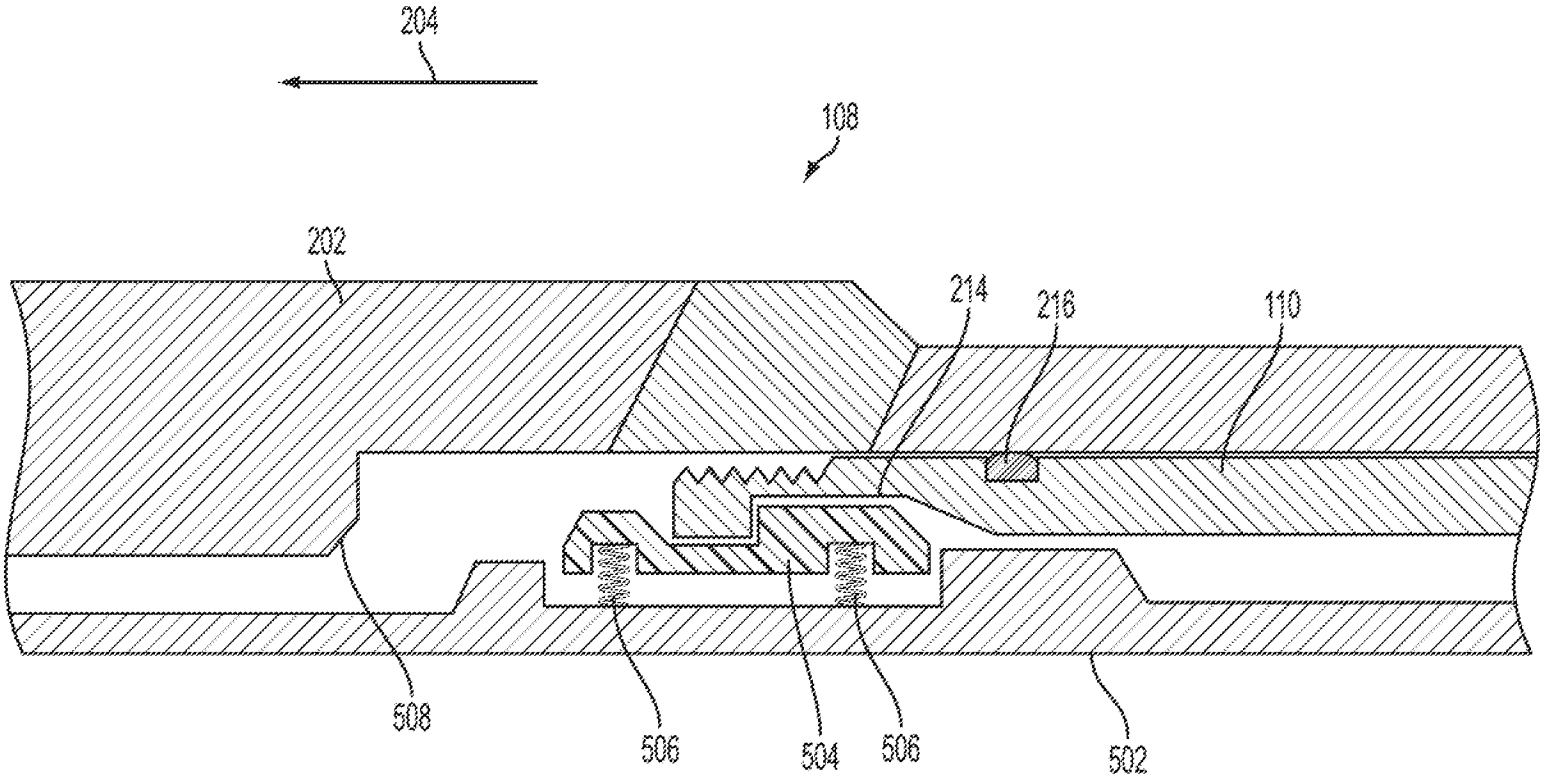
FIG. 5 is a cross-sectional view of a gravel packing assembly with a port sleeve in an open position and engaged with a shifting tool according to one embodiment.

FIG. 5 is a cross-sectional view of a gravel packing assembly 112 with a port sleeve 110 in an open position engaged with a shifting tool 502 according to one embodiment. The shifting tool 502 includes an engaging profile 504 and biasing elements 506 that bias the engaging profile 504 radially outwards. As the engaging profile 504 passes the first shifting profile 214, the engaging profile 504 can lock into place in the first shifting profile 214 to allow force exerted to move the shifting tool 502 to pass into the port sleeve 110. Force can be continually applied in first direction 204 to cause the port sleeve 110 to shift to a closed position.

Figure 6:
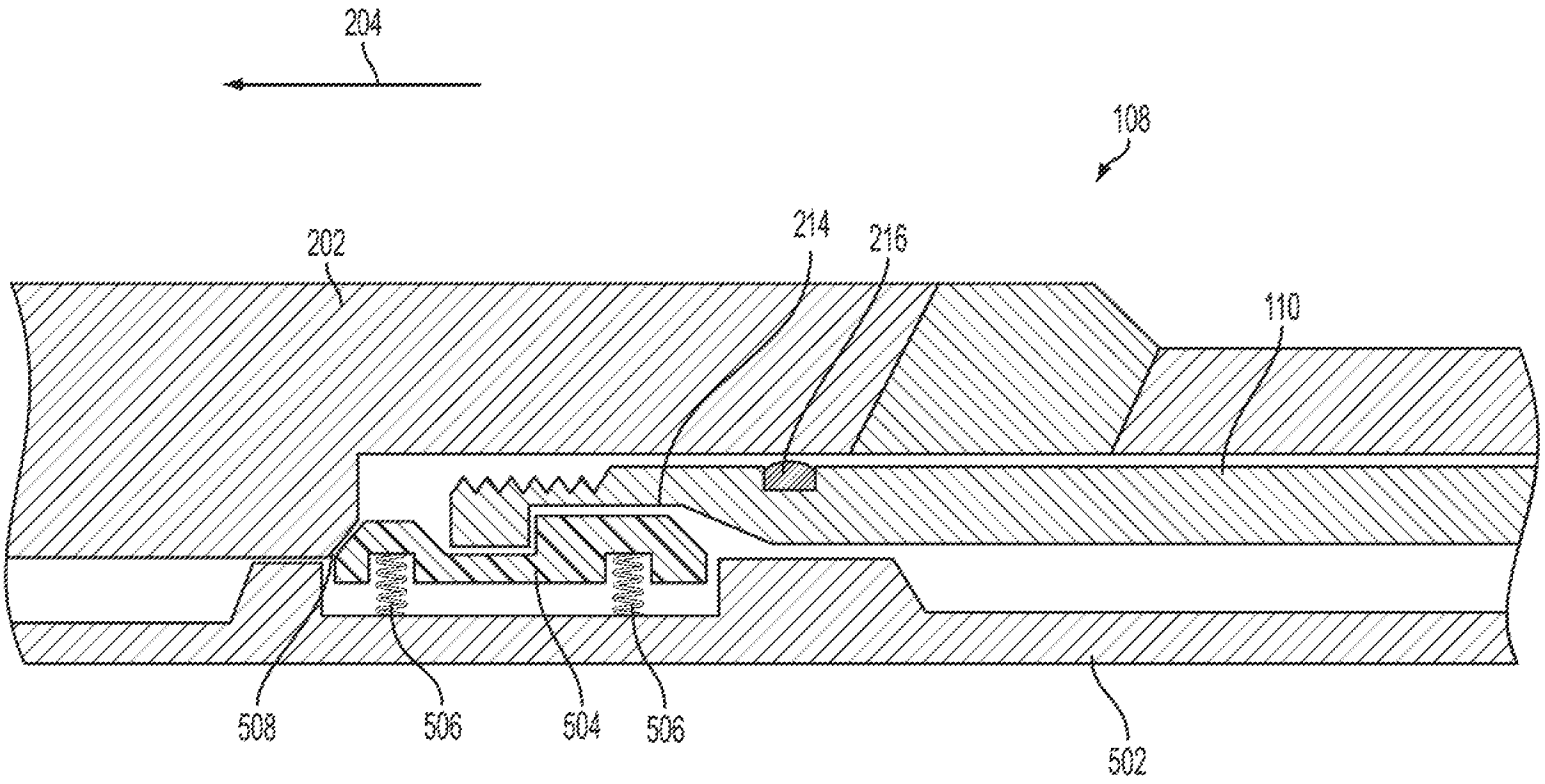
FIG. 6 is a cross-sectional view of the gravel packing assembly of FIG. 5 with the port sleeve in a closed position according to one embodiment.

FIG. 6 is a cross-sectional view of the gravel packing assembly 112 of FIG. 5 with the port sleeve 110 in a closed position according to one embodiment. In a closed position, the port sleeve 110 can occlude the port 108. The engaging profile 504, while still locked within the first shifting profile 214, can also engage an ejection profile 508 in the first tubular 202. The shifting tool 502 can continue to move in the first direction 204 to disengage the engaging profile 504 from the first shifting profile 214 due to the interaction of the engaging profile 504 with the ejection profile 508 that forces the engaging profile 504 radially inwards.

Figure 7:
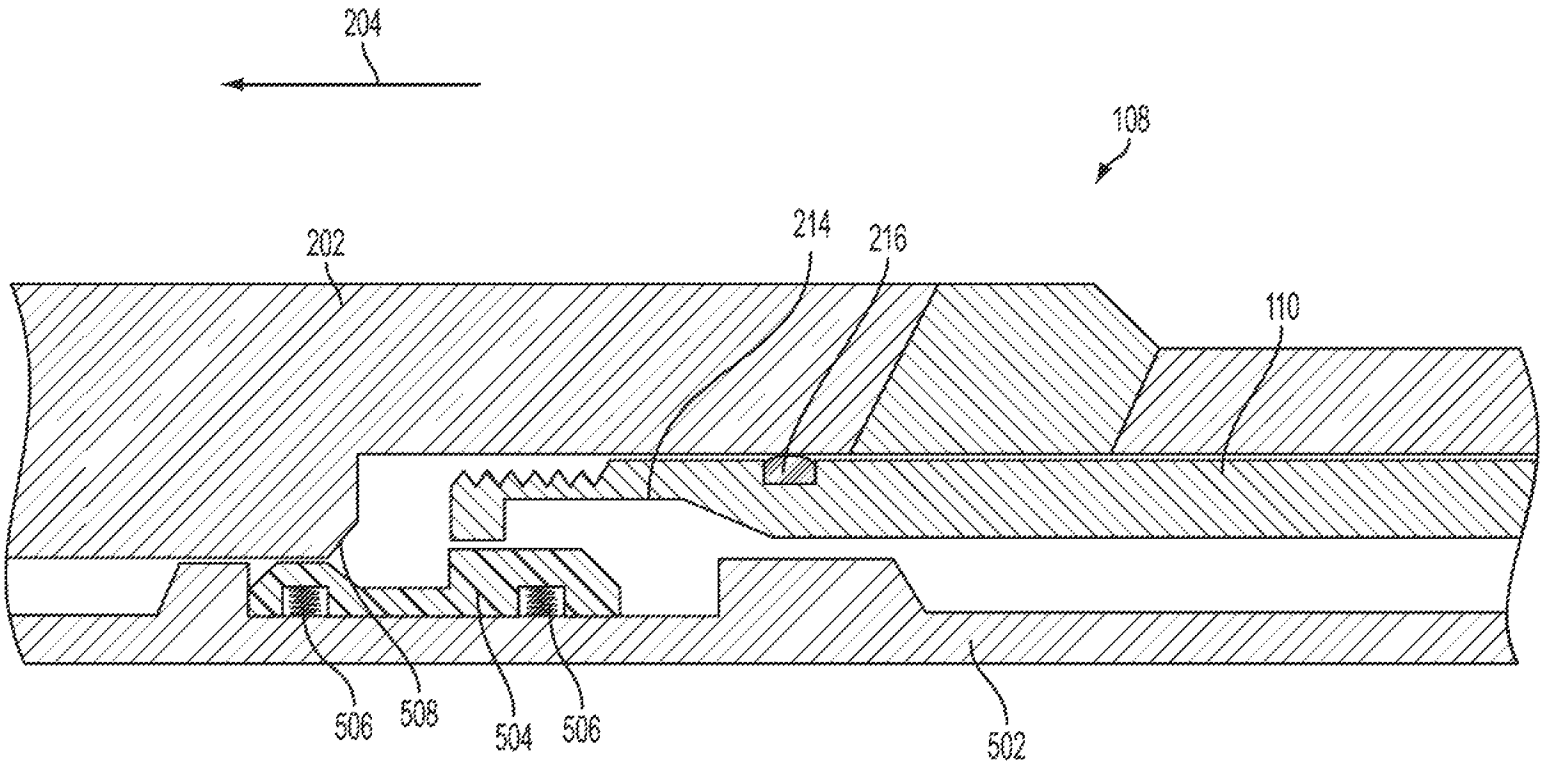
FIG. 7 is a cross-sectional view of the gravel packing assembly of FIG. 5 with the port sleeve in a closed position according to one embodiment.

FIG. 7 is a cross-sectional view of the gravel packing assembly 112 of FIG. 5 with the port sleeve 110 in a closed position according to one embodiment. The engaging profile 504 of the shifting tool 502 can be forced radially inwards by interaction with the ejection profile 508.

The process of shifting the port sleeve 110 closed, as depicted in FIGS. 5-7, can also be used to shift a port sleeve 110 to an open position by having a shifting tool with an engaging profile shaped to engage the second shifting profile 230 when moving in the second direction 240.

Figure 8:
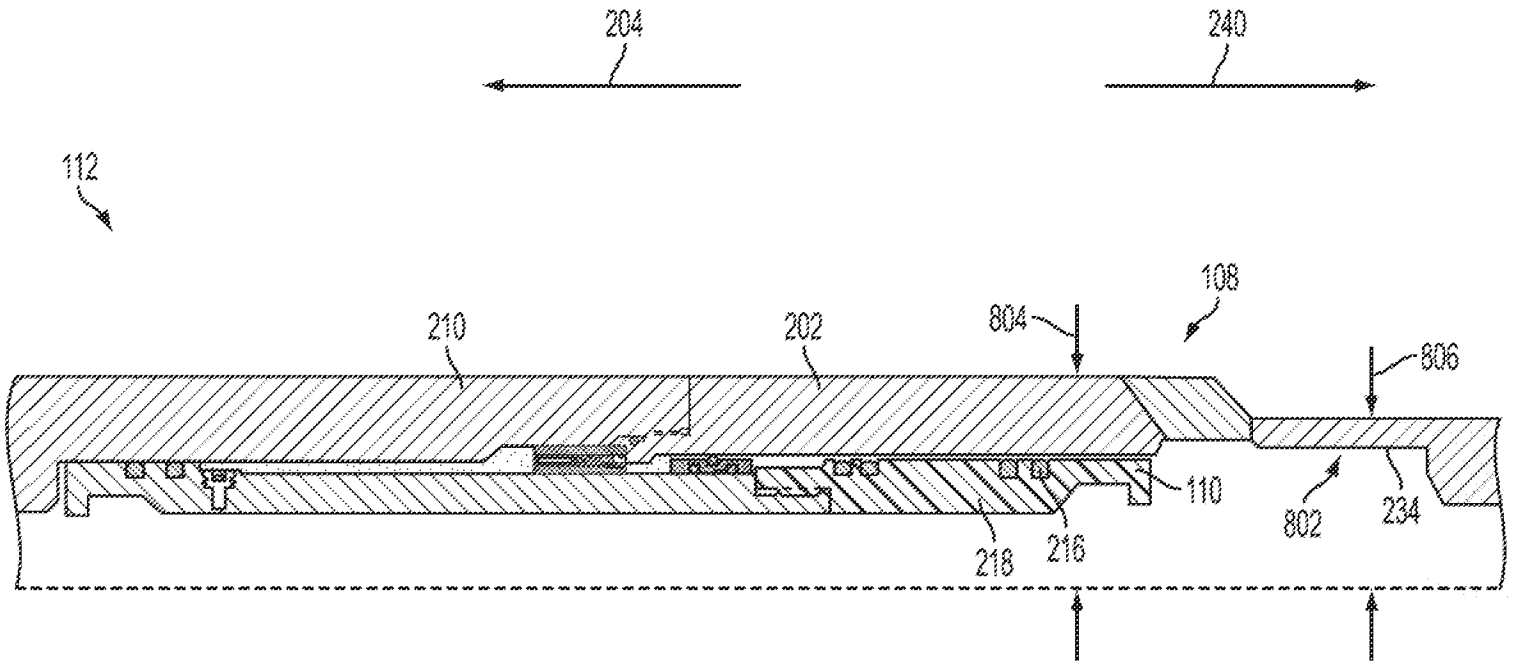
FIG. 8 is a cross-sectional view of a gravel packing assembly having a port sleeve in a closed position according to one embodiment.

FIG. 8 is a cross-sectional view of a gravel packing assembly 112 having a port sleeve 110 in an open position according to one embodiment. As seen in FIG. 8, the surface of the wellbore is towards the left side of the image and the toe of the wellbore is towards the right side of the image. The gravel packing assembly 112 of FIG. 8 can include the same basic elements as the gravel packing assembly 112 of FIG. 2A. The port 108 of the gravel packing assembly 112 of FIG. 8 is positioned proximate the downwell end of the gravel packing assembly 112 and the port sleeve 110 opens the port 108 (e.g., moves to an open position) by sliding towards the surface of the wellbore in first direction 204. Additionally, the gravel packing assembly 112 of FIG. 8 differs from the gravel packing assembly 112 of FIG. 2A in the diameters of the first tubular 202 and second tubular 210.

Referring again to FIG. 8, the first tubular 202 can have a first radius 804 upwell of the port 108 and a second radius 806 downwell of the port 108. The first radius 804 can be larger than the second radius 806 to encourage any fluid exiting the port 108 to flow downwell (e.g., in second direction 240). The larger first radius 804 can provide some resistance to fluid flow upwell (e.g., in first direction 204). The radius of the second tubular 210, when present, can be generally the same as the first radius 804.

Positioning the port 108 proximate the downwell end of the gravel packing assembly 112 can increase the life of the gravel packing assembly 112. In use, fluid will generally migrate from the surface of the wellbore (e.g., the left side of FIG. 8), through the center of the gravel packing assembly 112, and out of the port 108. The fluid, which can contain proppant and other matter, can pass over the exposed sealing surface 802 of the sleeve recess 234 of the first tubular 202. As fluid passes over the sleeve recess 234, the sealing surface 802 can gradually erode over time, which can cause premature failing of the seals 216. In embodiments having the port 108 positioned proximate the downwell end of the gravel packing assembly 112 (e.g., as seen in FIG. 8), less fluid passes over the sealing surface 802 as the fluid passes through the inner diameter of the gravel packing assembly 112 to port 108, resulting in slower erosion of the sealing surface 802. Conversely, if the port 108 is positioned proximate the upwell end of the gravel packing assembly 112 (e.g., as seen in FIG. 2A), more fluid may pass over the surface of the sleeve recess 234, which can lead to more erosion of the sealing surface of the sleeve recess 234, which can further lead to premature failure of the seals 216.

The port 108 can be similarly positioned proximate the downwell end of the gravel packing assembly 112 in other embodiments, such as the embodiment shown in FIG. 4, with the aforementioned adjustments to the diameters of the first tubular 202.

The foregoing description of the embodiments, including illustrated embodiments, has been presented only for the purpose of illustration and description and is not intended to be exhaustive or limiting to the precise forms disclosed. Numerous modifications, adaptations, and uses thereof will be apparent to those skilled in the art.

As used below, any reference to a series of examples is to be understood as a reference to each of those examples disjunctively (e.g., "Examples 1-4" is to be understood as "Examples 1, 2, 3, or 4").

Example 1 is a port assembly including a port sleeve, a first chamber, a second chamber, and a fluid flow controller. The port sleeve is shiftable between a closed position at which the port sleeve is operable to substantially prevent fluid flow through a port and an open position at which the port sleeve is operable to substantially allow fluid flow through the port. The first chamber is operable to change in volume in response to movement of the port sleeve. The first chamber also includes an incompressible fluid. The fluid flow controller is operable to control flow of the incompressible fluid between the first chamber and the second chamber.

Example 2 is the assembly of Example 1, where the fluid flow controller is operable to both 1) allow flow of the incompressible fluid from the first chamber to the second chamber at a first rate, and 2) allow flow of the incompressible fluid from the second chamber to the first chamber at a second rate that is different than the first rate.

Example 3 is the assembly of Examples 1 or 2, where the fluid flow controller includes a hydraulic element to resist fluid flow between the first chamber and the second chamber when a pressure differential across the fluid flow controller is below a predetermined limit.

Example 4 is the assembly of Example 3, where the hydraulic element includes a sized orifice positioned between the first chamber and the second chamber.

Example 5 is the assembly of Examples 3 or 4, where the hydraulic element includes a check value located between the first chamber and the second chamber.

Example 6 is the assembly of Examples 1-5, where the first chamber includes a piston operable to change the volume of the first chamber in response to the movement of the port sleeve.

Example 7 is the assembly of Example 6, where the fluid flow controller includes a hydraulic element positioned on the piston.

Example 8 is the assembly of Examples 1-7, also including a balance piston having a first end exposed to an external environment and a second end exposed to the incompressible fluid, the balance piston operable to reduce a pressure differential between the external environment and the incompressible fluid.

Example 9 is the assembly of Examples 1-8, also including a rupture element occluding an escape port fluidly connecting the fluid flow controller to an external environment.

Example 10 is the assembly of Examples 1-9, where the fluid flow controller is operable to allow the movement of the port sleeve in response to a constant application of force.

Example 11 is a method for opening a port including changing a volume of a first chamber in response to movement of a port sleeve; resisting movement of the port sleeve by controlling flow of a fluid from the first chamber to a second chamber by a fluid flow controller positioned between the first chamber and the second chamber; and allowing the movement of the port sleeve, by the fluid flow controller, in response to a continued application of force.

Example 12 is the method of Example 11, where resisting the movement of the port sleeve includes resisting fluid flow across a hydraulic element of the fluid flow controller when a pressure differential across the hydraulic element is below a predetermined limit.

Example 13 is the method of Examples 11 or 12, where resisting the movement of the port sleeve by controlling flow of a fluid form the first chamber to the second chamber includes resisting the movement of the port sleeve in a first direction by a first amount, and resisting the movement of the port sleeve in a second direction by a second amount, wherein the second amount is different from the first amount.

Example 14 is a system including a fluid flow controller coupled with a port sleeve to control a rate of movement of the port sleeve between a closed position at which the port sleeve is operable to substantially prevent fluid flow through a port and an open position at which the port sleeve is operable to substantially allow fluid flow through the port.

Example 15 is the system of Example 14 where the fluid flow controller includes a hydraulic element operable to resist movement of the port sleeve until a predetermined minimum amount of pressure is applied to move the port sleeve.

Example 16 is the system of Examples 14 or 15 where the fluid flow controller includes a plurality of hydraulic elements to control an opening rate of movement of the port sleeve at a speed that is different from a closing rate of movement of the port sleeve.

Example 17 is the system of Examples 14-16 where the fluid flow controller is operable to allow movement of the port sleeve in response to a constant application of force.

Example 18 is the system of Example 17 also including comprising a balance piston positioned to reduce a pressure differential between an external environment and a fluid that passes through the fluid flow controller.

Example 19 is the system of Examples 14-18 where the fluid flow controller includes a valve positioned on a piston, the piston being mechanically coupled to the port sleeve and operable to move within a piston chamber in response to movement of the port sleeve.

Examples 20 is the system of Examples 14-19 also including a rupture element occluding an escape port fluidly connecting an external environment to the fluid flow controller, the rupture element operable to open the escape port to fluid flow in response to exposure to a pre-determined pressure differential across the rupture element.

What is claimed is:

1. A port assembly, comprising:

a port sleeve shiftable between a closed position at which the port sleeve is operable to substantially prevent fluid flow through a port and an open position at which the port sleeve is operable to substantially allow fluid flow through the port;

a first chamber operable to change in volume in response to movement of the port sleeve, the first chamber including an incompressible fluid; and a fluid flow controller positioned between the first chamber and a second chamber, the fluid flow controller having one or more fluid pathways disposed therethrough and fluidically connecting the first chamber and the second chamber, the fluid flow controller configured to (i) communicate the incompressible fluid from the first chamber to the second chamber through the one or more fluid pathways at a first rate in response to the port sleeve shifting from the closed position to the open position, and (ii) communicate the incompressible fluid from the second chamber to the first chamber through the one or more fluid pathways at a second rate that is different from the first rate in response to the port sleeve shifting from the open position to the closed position.

2. The port assembly of claim 1, wherein the fluid flow controller includes a hydraulic element within the one or more fluid pathways, the hydraulic element being configured to resist fluid flow between the first chamber and the second chamber when a pressure differential across the fluid flow controller is below a predetermined limit.

3. The port assembly of claim 2, wherein the hydraulic element includes a orifice positioned within the one or more fluid pathways and sized to restrict fluid flow through the one or more fluid pathways to the first rate.

4. The port assembly of claim 2, wherein the hydraulic element includes a check valve located within the one or more fluid pathways and configured to restrict fluid flow from the first chamber to the second chamber to the first rate.

5. The port assembly of claim 1, wherein a first end of the first chamber is defined by a piston operable to change the volume of the first chamber in response to the movement of the port sleeve, and a second end of the first chamber is defined by the fluid flow controller, the second end being opposite to the first end.

6. The port assembly of claim 5, wherein a hydraulic element is positioned on the piston.

7. The port assembly of claim 1, additionally comprising a balance piston having a first end exposed to an external environment and a second end exposed to the incompressible fluid, the balance piston operable to reduce a pressure differential between the external environment and the incompressible fluid.

8. The port assembly of claim 1, additionally comprising a rupture element positioned between the second chamber and an external environment, the rupture element occluding an escape port in the port sleeve.

9. The port assembly of claim 1, wherein the fluid flow controller is operable to allow the movement of the port sleeve in response to a constant application of force.

10. The port assembly of claim 1, wherein:

the one or more fluid pathways includes a first fluid pathway and a second fluid pathway;

the first fluid pathway is configured such that the incompressible fluid is to flow in a first direction from the first chamber to the second chamber at the first rate; and the second fluid pathway is configured such that the incompressible fluid is to flow in a second direction from the second chamber to the first chamber at the second rate, the second fluid pathway having a different resistance to fluid flow than the first fluid pathway and the second direction being opposite to the first direction.

11. The port assembly of claim 10, wherein the fluid flow controller includes:

a first valve operable to limit fluid flow through the first fluid pathway to the first rate in response to an amount of force; and a second valve operable to limit fluid flow through the second fluid pathway to the second rate in response to the amount of force.

12. A method for opening a port, the method comprising:

changing a volume of a first chamber in response to movement of a port sleeve; and resisting, by a fluid flow controller positioned between the first chamber and a second chamber, movement of the port sleeve by controlling flow of a fluid through at least one fluid pathway within the fluid flow controller from the first chamber to the second chamber, wherein the fluid flow controller is configured to (i) resist the movement of the port sleeve in a first direction with a first amount of resistance when an amount of force is applied to the port sleeve, and (ii) resist the movement of the port sleeve in a second direction with a second amount of resistance when the amount of force is applied to the port sleeve, the second amount of resistance being different from the first amount of resistance.

13. The method of claim 12, wherein resisting the movement of the port sleeve includes resisting fluid flow across a hydraulic element within the at least one fluid pathway when a pressure differential across the hydraulic element is below a predetermined limit.

14. The method of claim 12, wherein resisting the movement of the port sleeve by controlling flow of the fluid through at least one fluid pathway extending through the fluid flow controller from the first chamber to the second chamber includes:

limiting fluid flow in the first direction to a first pathway through the fluid flow controller between the first chamber and the second chamber; and limiting fluid flow in the second direction to a second pathway through the fluid flow controller between the first chamber and the second chamber, the second pathway having a different resistance to fluid flow than the first pathway.

15. A system, comprising:

a fluid flow controller coupled with a port sleeve to control a rate of movement of the port sleeve between (i) a closed position at which the port sleeve is operable to substantially prevent fluid flow through a port, and (ii) an open position at which the port sleeve is operable to substantially allow fluid flow through the port, wherein the fluid flow controller includes at least one pathway fluidically connecting a first chamber to a second chamber; and wherein the fluid flow controller is configured to allow the port sleeve to move from (i) the closed position to the open position by communicating fluid from a first chamber to a second chamber through the at least one pathway at a first rate in response to an amount of force, and (ii) the open position to the closed position by communicating fluid from the second chamber to the first chamber through the at least one pathway at a second rate in response to the amount of force, the second rate being different than the first rate.

16. The system of claim 15, wherein the at least one pathway includes a hydraulic element operable to resist movement of the port sleeve until a predetermined minimum amount of pressure is applied to move the port sleeve.

17. The system of claim 15, wherein the at least one pathway includes a plurality of hydraulic elements to control an opening rate of movement of the port sleeve at a speed that is different from a closing rate of movement of the port sleeve.

18. The system of claim 15, wherein the fluid flow controller is operable to allow movement of the port sleeve in response to a constant application of force.

19. The system of claim 18, additionally comprising a balance piston positioned to reduce a pressure differential between an external environment and a fluid that passes through the fluid flow controller.

20. The system of claim 15, wherein the fluid flow controller is positioned on a piston, the piston being mechanically coupled to the port sleeve and operable to move within a piston chamber in response to movement of the port sleeve, the piston chamber comprising the first chamber and the second chamber.

21. The system of claim 15, wherein the second chamber includes a rupture element occluding an escape port fluidly connecting an external environment to the fluid flow controller, the rupture element operable to open the escape port to fluid flow in response to exposure to a pre-determined pressure differential across the rupture element.

* * * * *